US009601060B2

(12) United States Patent
Gyu

(10) Patent No.: US 9,601,060 B2
(45) Date of Patent: Mar. 21, 2017

(54) IMAGE PROCESSING METHOD AND APPARATUS

(71) Applicant: BOE Technology Group Co., Ltd., Beijing (CN)

(72) Inventor: Jung Chul Gyu, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 47 days.

(21) Appl. No.: 14/497,896

(22) Filed: Sep. 26, 2014

(65) Prior Publication Data

US 2015/0348467 A1 Dec. 3, 2015

(30) Foreign Application Priority Data

May 29, 2014 (CN) ..... 2014 1 0234431

(51) Int. Cl.
*G09G 3/00* (2006.01)
*G09G 3/34* (2006.01)
*G09G 3/36* (2006.01)

(52) U.S. Cl.
CPC ..... *G09G 3/3406* (2013.01); *G09G 3/006* (2013.01); *G09G 3/3611* (2013.01); *G09G 2320/0233* (2013.01); *G09G 2320/0693* (2013.01); *G09G 2360/16* (2013.01)

(58) Field of Classification Search
CPC ..... G09G 2320/0233
See application file for complete search history.

(56) References Cited

U.S. PATENT DOCUMENTS

2009/0051907 A1* 2/2009 Li ..... G02F 1/1309 356/218
2010/0245397 A1* 9/2010 Choe ..... G09G 3/342 345/690
2010/0253696 A1* 10/2010 Choi ..... G09G 3/3426 345/589

(Continued)

OTHER PUBLICATIONS

Second Office Action, including Search Report, for Chinese Patent Application No. 201410234431.4, dated Jan. 26, 2016, 11 pages.

*Primary Examiner* — Viet Pham
*Assistant Examiner* — Christopher Kohlman
(74) *Attorney, Agent, or Firm* — Westman, Champlin & Koehler, P.A.

(57) ABSTRACT

The disclosure of the present invention provides an image processing method and apparatus. The method comprises acquiring a single picture image displayed on a display panel; determining an average value of each area relating to a display parameter, after the acquired single picture image is divided into a plurality of areas according to a preset regulation; determining differences between average values of respective two adjacent areas, and determining a uniformity of the single picture image displayed on the display panel in accordance with a relationship between each difference and a threshold of a resolvable picture uniformity by an human eye; adjusting the difference between the average values of the respective two adjacent areas to be not greater than the threshold of the resolvable picture uniformity by the human eye, when determining the single picture image displayed on the display panel to be not uniform.

20 Claims, 4 Drawing Sheets

(56) References Cited

U.S. PATENT DOCUMENTS

| | | | | |
|---|---|---|---|---|
| 2011/0157255 | A1* | 6/2011 | Hsu | G09G 3/342<br>345/690 |
| 2012/0032998 | A1* | 2/2012 | An | G09G 3/3696<br>345/690 |
| 2014/0240201 | A1* | 8/2014 | Takahashi | G06F 3/1446<br>345/1.3 |

* cited by examiner

IMAGE PROCESSING METHOD AND APPARATUS

CROSS-REFERENCE TO RELATED APPLICATION

This application claims the benefit of Chinese Patent Application No. 201410234431.4 filed on May 29, 2014 in the State Intellectual Property Office of China, the whole disclosure of which is incorporated herein by reference.

BACKGROUND OF THE INVENTION

Field of the Invention

The present disclosure relates to a technical field of display, more particularly, to an image processing method and apparatus.

Description of the Related Art

With the development of photoelectric and semiconductor techniques, the flat-panel display has become mainstream of display devices in virtue of its advantages such as thin thickness and portable convenience, replacing the conventional CRT display. The liquid crystal display (LCD) having excellent properties, such as high quality definition, high space availability, low power of electrical supply, and no radiation, has become mainstream products in the flat-panel display market, especially in the TV field. LCTV (liquid crystal television) leads over the market in terms of its market share. Organic light emitting display (OLED) also becomes another mainstream of the display devices, due to its characteristics of quick response, wide color gamut, ultrathin thickness, and flexibility.

Both LCD display and OLED display need to be subject to a series of tests before they leave the factory. The tests include for example those related to brightness uniformity of images displayed on the display. The existing test typically is done manually, that is, after the display is adjusted to display a black picture, a tester determines whether the brightness of the respective areas on the screen of the display is uniform or not, or whether there is a light leakage on the screen or not, by means of his/her eyes. The test cannot be done by human eyes with a unified standard, and thus the defects of non-uniform brightness and/or light leakage are likely to be missed. In addition, when it has been detected by the human eyes that the brightness of the screen is not uniform, it is difficult to adjust it to comply with the standard. The only way is to discard the defective product, thus increasing the production cost.

Therefore, one of the technical problems to be solved urgently in the test field of the flat panel display is how to test and adjust the uniformity of the image displayed on the display with the unified standard.

SUMMARY OF THE INVENTION

The disclosure of the present invention provides an image processing method and apparatus, so that the uniformity of the image displayed on the display can be adjusted with a unified standard.

In accordance with one aspect of the present invention, it provides an image processing method, comprising the steps of:

acquiring a single picture image displayed on a display panel;

determining an average value of each area relating to a display parameter, after the acquired single picture image is divided into a plurality of areas according to a preset regulation;

determining differences between average values of respective two adjacent areas, and determining a uniformity of the single picture image displayed on the display panel in accordance with a relationship between each difference and a threshold of a resolvable picture uniformity by an human eye;

adjusting the difference between the average values of the respective two adjacent areas to be not greater than the threshold of the resolvable picture uniformity by the human eye, when it is determined that the single picture image displayed on the display panel is not uniform.

In accordance with another aspect of the present invention, it also provides an image processing apparatus, comprising:

an image acquiring unit, configured to acquire a single picture image displayed on a display panel;

a first determining unit, configured to determine an average value of each area relating to a display parameter, after the acquired single picture image is divided into a plurality of areas according to a preset regulation;

a second determining unit, configured to determine differences between average values of respective two adjacent areas, and determine a uniformity of the single picture image displayed on the display panel in accordance with a relationship between each difference and a threshold of a resolvable picture uniformity by an human eye;

an adjusting unit, configured to adjust the difference between the average values of the respective two adjacent areas to be not greater than the threshold of the resolvable picture uniformity by the human eye, when it is determined that the single picture image displayed on the display panel is not uniform.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF PREFERRED EMBODIMENTS OF THE INVENTION

Figure 1:
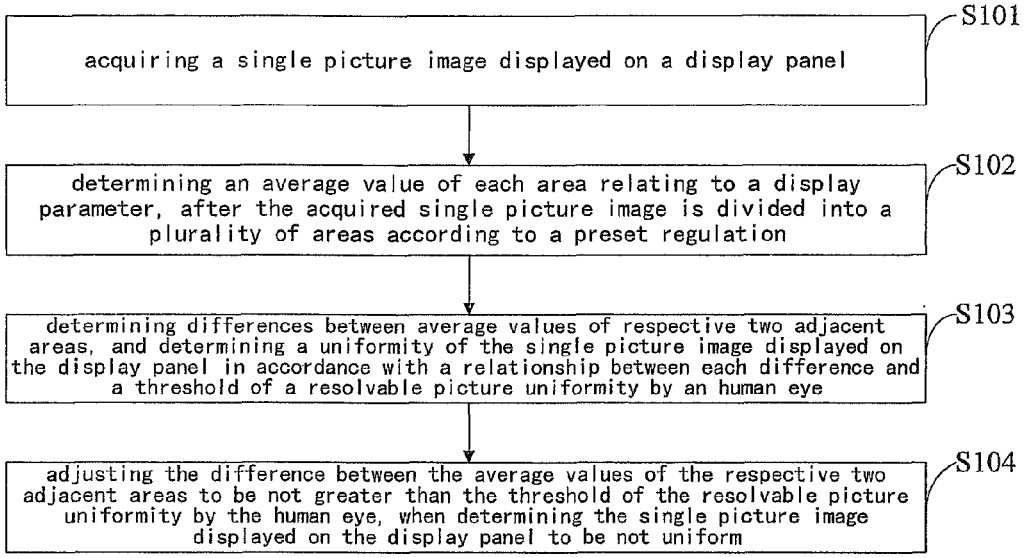
FIG. 1 is a flowchart of an image processing method for determining and adjusting a uniformity of an image displayed on a display panel in accordance with an embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Specific embodiments of an image processing method and an image processing apparatus in accordance with an embodiment of the present invention are explained in detail with reference to the accompanying drawings.

In one embodiment of the present invention, as shown in FIG. 1, the image processing method includes the following steps:

S101 acquiring a single picture image displayed on a display panel

In one implementation, the acquiring step can be achieved by for example a CCD image acquiring device. In addition, in order to obtain the image each time with a unified standard, the single picture image displayed on the display panel can be obtained at a location where the image acquiring device is arranged at an angle of 2 degrees to the display panel, when the standard light source D65 is illuminating the display panel. Said single picture can be a picture having a uniform grey, for example, a black picture of displaying L0, and so on.

S102 after the acquired singe picture image is divided into a plurality of areas according to a preset regulation, determining an average value of each area relating to a display parameter Specifically, the average value relating to the display parameter can be an average value of brightness and/or chromaticity. In the following explanation, the average value of brightness is taken as one example.

After the single picture image is acquired, in order to avoid the problem of a large amount of data calculation during the subsequent calculation, it is possible to divide the acquired single picture image into a plurality of areas according to a preset regulation. Specifically, the dividing regulation may have many forms. This is not limited herein. For example, regardless of the size of the original image, each acquired image can be divided into 9*9 equal areas according to the regulation of the number of the divided areas being equal. Each area is regarded as a whole, and the average values of the respective areas are calculated. Alternatively, the acquired original image can be divided according to the regulation of each 9*9 pixel points forming one area. Then, the average value of each area is calculated respectively. In practice, the preset dividing regulations can be determined as required actually.

When determining the average value of each area, the average value of the brightness of the respective pixel points within each area can be used as the average value of said area. Alternatively, the average value of the chromaticity of the respective pixel points within each area can be used as the average value of said area. Of course, it is also possible to use the average value of the brightness and chromaticity of the respective pixel points within each area as the average value of said area, and this is not limited herein.

S103 determining differences between the average values of respective adjacent two areas, and determining uniformity of the single picture image displayed on the display panel based on a relationship (for example, size or ratio relationship thereof) between each difference and a threshold of the resolvable picture uniformity by the human eye.

Figure 2A:
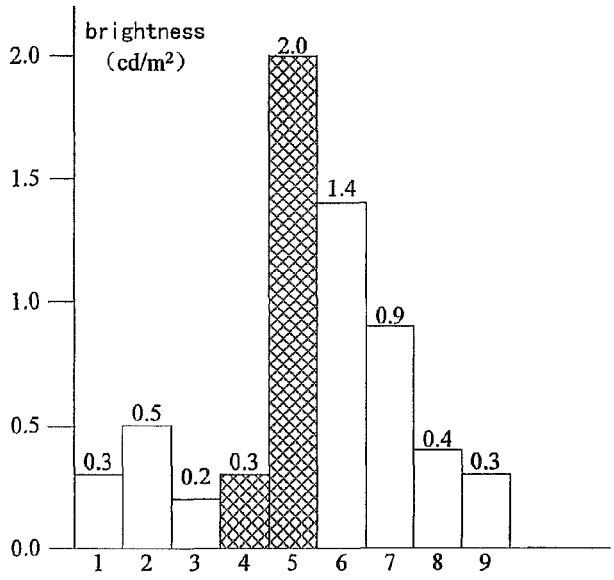
FIGS. 2*a*-2*d* are respectively histogram schematic views showing an average value of brightness of the respective areas in the image processing method in accordance with the embodiment of the present invention.

In one example, the average value of each area determined in the step S102 can be used to set up a histogram of the data, as shown in FIG. 2*a*. The differences between the average values of two adjacent areas can be seen intuitively from the figure.

Specifically, when determining the uniformity of the single picture image displayed on the display panel according to the relationship between the respective differences and the threshold of the resolvable picture uniformity by the human eye, the determination can be done in accordance with the following regulations (herein, for simplifying the description, it is illustrated by taking the size relationship as an example. Of course, the determination can be done in accordance with the ratio relationship or other suitable relationships): when any one of the differences is determined to be greater than the threshold of the resolvable picture uniformity by the human eye, the single picture image displayed on the display panel is determined to be not uniform. Of course, when all the differences are determined to be not greater than the threshold of the resolvable picture uniformity by the human eye, the single picture image displayed on the display panel can be determined to be uniform.

It should be noted that the threshold of the resolvable picture uniformity by the human eye as described above is meant to a critical value at which the human eye can resolve the non-uniformity of the picture. The critical value can be a numerical range. This can be slightly adjusted in accordance with the sensitivity of the human eye to different colors.

S104 adjusting the difference between the average values of the respective two adjacent areas to be not greater than the threshold of the resolvable picture uniformity by the human eye, when the single picture image displayed on the display panel is determined to be not uniform.

In practice, when the single picture image displayed on the display panel is determined to be not uniform, the following two adjusting means can be used to adjust the display panel, so that the difference between the average values of the respective two adjacent areas is adjusted to be not greater than the threshold of the resolvable picture uniformity by the human eye. Finally, all the non-uniform areas on the images displayed on the display panel cannot be resolved by the human eye (i.e., reaching the irresolvable level of the human eye), thereby further improving the grade of the screen of the display panel.

First Adjusting Means:

Two adjacent areas, which correspond to any difference among all the differences that is greater than the threshold of the resolvable picture uniformity by the human eye, are determined firstly, as shown in FIG. 2*a*. In the case that the threshold of the resolvable picture uniformity by the human eye is preset to be 0.5, only the difference between the average values of the areas 4 and 5 among all the shown areas is larger than said threshold, wherein one area has an average value of 2.0, and the other has an average value of 0.3.

Figure 2B:
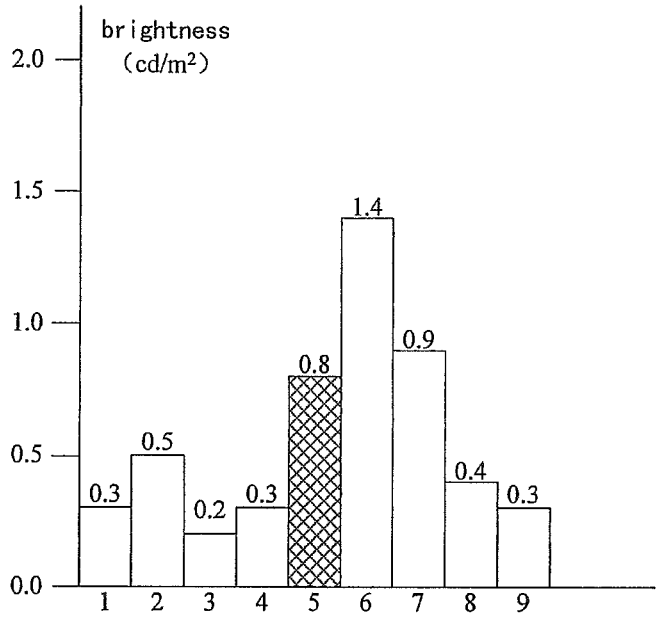

Then, one area of two adjacent areas corresponding to the difference greater than the threshold of the resolvable picture uniformity by the human eye, which has a lower average value, can be used as a reference area. With reference to the reference area, the average value of the other area is adjusted so that the difference between the two areas is not greater than the threshold of the resolvable picture uniformity by the human eye. For example, as shown in FIG. 2*b*, the area 4 is used as the reference area, and the brightness of each pixel point within the area 5 is adjusted so that the difference between the average value of the area 5 and the average value of the area 4 equals to 0.5. That is, the average value of the area 5 is adjusted to be 0.8.

Figure 2C:
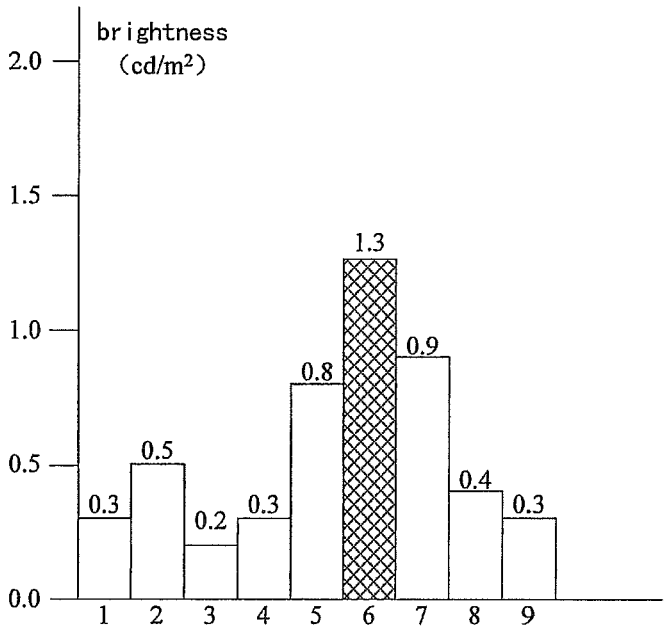

Then, when determining the difference between the adjusted average value of the other area and the average values of other adjacent areas to be greater than the threshold of the resolvable picture uniformity by the human eye, the average values of the other adjacent areas are adjusted to enable the differences between the average value of the other area and the average values of the other adjacent areas to be not greater than the threshold of the resolvable picture uniformity by the human eye. Further, the above steps are repeated until the difference between the adjusted average values of the respective two adjacent areas is not greater than the threshold of the resolvable picture uniformity by the human eye. For example, as shown in FIG. 2*c*, the difference between the adjusted average value of the area 5 and the average value of the area 6 is greater than the threshold of the resolvable picture uniformity by the human eye. Therefore, the average value of the area 6 should be adjusted so that it meets the condition of the difference between the average values of it and the area 5 being less than or equal to the threshold of the resolvable picture uniformity by the human eye. In turn, the average values of other areas adjacent to the area 6 are adjusted with reference to the area 6, until the difference between the average values of the respective two adjacent areas is less than or equal to the threshold of the resolvable picture uniformity by the human eye.

Second Adjusting Means

Firstly, the area which has the largest average value among all the areas should be determined. For example, as shown in FIG. 2*a*, the area 5 is determined to have the largest average value.

Figure 2D:
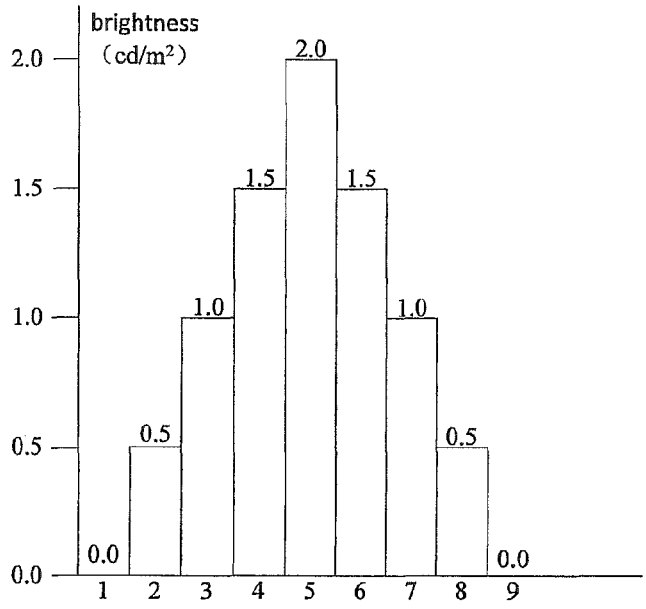

Then, the area having the largest average value is used as the reference area for adjusting the average values of other areas than the reference area. In this way, the difference between the average values of the respective two adjacent areas is adjusted to be not greater than the resolvable picture uniformity by the human eye. For example, as shown in FIG. 2*d*, the area 5 is used as the reference area, the brightness of the respective pixel points within the areas 4 and 6 are adjusted so that the difference between the average values of the areas 4 and 5 equals to 0.5. Analogously, the differences between the average values of the respective two adjacent areas equal to 0.5.

In the first adjusting means, one area of two adjacent areas corresponding to the difference greater than the threshold of the resolvable picture uniformity by the human eye, which has the lower average value, is used as a reference area. The average values of other areas should be adjusted. Therefore, the variation of the adjusted average value of the respective area is relatively small. However, when the display panel is determined to have several areas having differences greater than the threshold of the resolvable picture uniformity by the human eye, all of them should be adjusted respectively. In this case, many times of the adjustments may be needed so that the differences between the average values of the adjacent areas among all the areas satisfy the condition of being less than or equal to the threshold of the resolvable picture uniformity by the human eye. Therefore, the first adjusting means may be relatively complex in terms of calculation.

In the second adjusting means, the area having the largest average value is used as the reference area for adjusting the average values of other areas than the reference area. In this way, the difference between the average values of the respective two adjacent areas equals to the threshold of the resolvable picture uniformity by the human eye. The variation of the adjusted average values of the respective areas by this way is relatively large. This probably results in increasing the average value of the brightness of the entire display picture.

Figure 3:
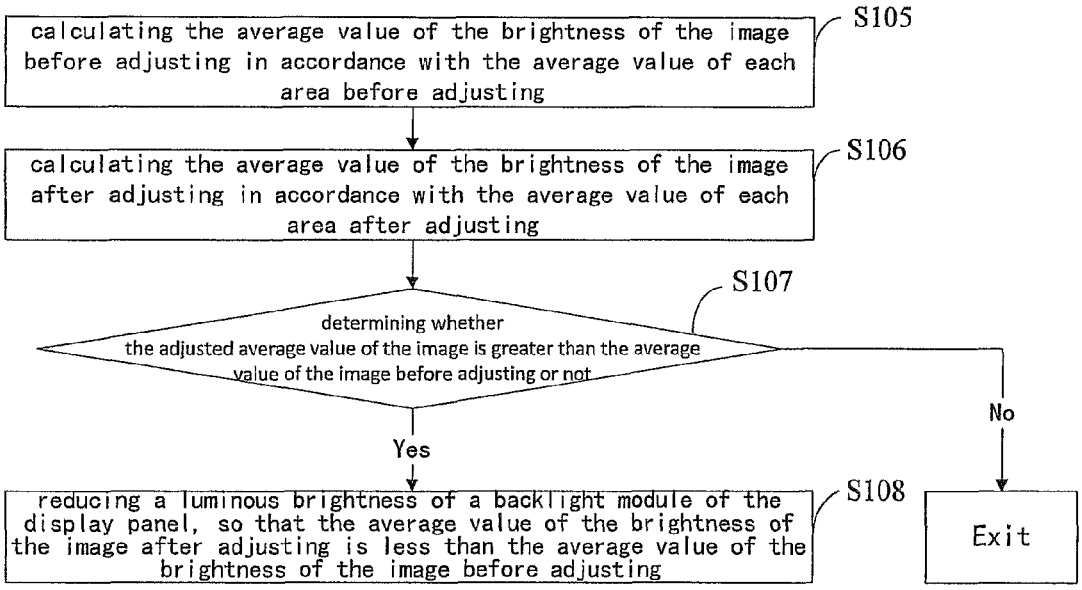
FIG. 3 is a flowchart of adjusting the brightness of the image displayed on the display panel in the case that the brightness of a single picture image displayed on the display panel is determined to be not uniform, in accordance with another embodiment of the present invention.

In order to solve this problem, in the above method in accordance with the embodiment of the present invention, it may further include the step of adjusting the brightness of the display panel, as shown in FIG. 3:

S105 calculating the average value of the brightness of the image before adjusting in accordance with the average value of each area before adjusting, before the difference between the average values of the respective two adjacent areas is adjusted to be not greater than the threshold of the resolvable picture uniformity by the human eye (i.e., after the step S103, and before the step S104);

S106 calculating the average value of the brightness of the image after adjusting in accordance with the average value of each area after adjusting, after the difference between the average values of the respective two adjacent areas is adjusted to be not greater than the threshold of the resolvable picture uniformity by the human eye (i.e., after the step S104);

S107 determining whether the adjusted average value of the image is greater than the average value of the image before adjusting or not.

If yes, a step S108 is performed. For example, as shown in FIG. 2*a*, the average value of the brightness of the image before adjusting is 0.7. If the first adjusting means is employed, as shown in FIG. 2*c*, the average value of the brightness of the image after adjusting is 0.55; whereas if the second adjusting means is employed, as shown in FIG. 2*d*, the average value of the brightness of the image after adjusting is 0.88.

S108 reducing a luminous brightness of a backlight module of the display panel, so that the average value of the brightness of the image after adjusting is less than the average value of the brightness of the image before adjusting;

When using the second adjusting means, the average value of the brightness of the image after adjusting is greater than that of the image before adjusting. Therefore, it is necessary to reduce the luminous brightness of the backlight module so as to ensure the average value of the brightness of the image after adjusting to be less than the average value of the brightness of the image before adjusting.

Alternatively, in order to solve the above problem, in the above method in accordance with the embodiment of the present invention, it further uses the following steps:

After the difference between the average values of the respective adjacent two areas is adjusted to be not greater than the threshold of the resolvable picture uniformity by the human eye, the average value of brightness of the image after adjusting is calculated in accordance with the adjusted average value of each area.

The luminous brightness of the backlight module of the display panel is reduced by the average value of the brightness of the image after adjusting, so that it is possible to decrease the average brightness of the image after adjusting.

Based on the same inventive concept, another embodiment of the present invention also provides an image processing apparatus. Because the principle of the apparatus for solving the problem is similar to that of the image processing method, the details for implementing it can be referred to those of the method, and thus some of the details are not repeated herein.

Figure 4:
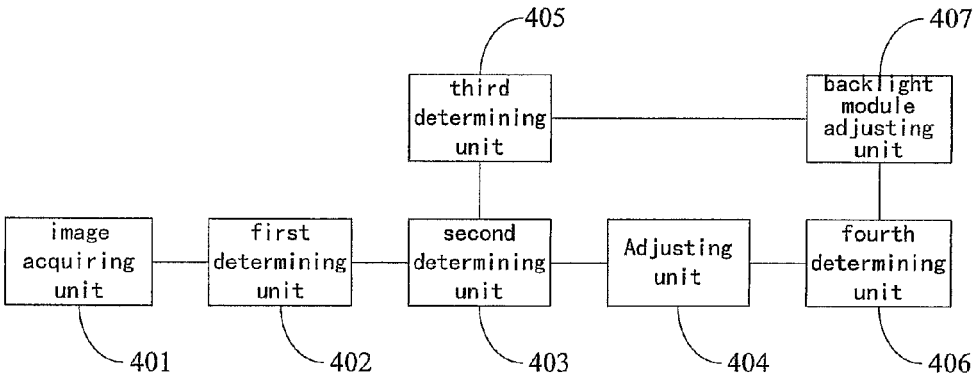
FIG. 4 is a block schematic view showing an image processing apparatus in accordance with an embodiment of the present invention.

In accordance with another embodiment of the present invention, as shown in FIG. 4, the image processing apparatus specifically includes:

an image acquiring unit 401, configured to acquire a single picture image displayed on the display panel;

a first determining unit 402, configured to determine an average value of each area relating to a display parameter, after the acquired single picture image is divided into a plurality of areas according to a preset regulation, wherein the average value is an average value of brightness and/or chromaticity;

a second determining unit 403, configured to determine differences between the average values of the respective two adjacent areas and determine the uniformity of the single picture image displayed on the display panel in accordance with the relationship of each difference with the threshold of the resolvable picture uniformity by the human eye;

an adjusting unit 404, configured to adjust the difference between the average values of the respective two adjacent areas to be not greater than the threshold of the resolvable picture uniformity by the human eye, when the single picture image displayed on the display panel is determined to be not uniform.

Further, in the image processing apparatus in accordance with another embodiment of the present invention, the second determining unit 403 is specifically used to determine the single picture image displayed on the display panel to be not uniform if any difference is greater than the threshold of the resolvable picture uniformity by the human eye, and to determine the single picture image displayed on the display panel to be uniform when all the differences are not greater than the threshold of the resolvable picture uniformity by the human eye.

Further, in the image processing apparatus in accordance with another embodiment of the present invention, the adjusting unit 404 is configured to specifically:

determine two adjacent areas corresponding to any difference among all the differences that are greater than the threshold of the resolvable picture uniformity by the human eye;

for the determined two adjacent areas, use one area having a lower average value as a reference area to adjust the average value of the other area so that the difference of them is not greater than the threshold of the resolvable picture uniformity by the human eye;

adjust average values of other areas adjacent to the other area so that the difference therebetween is not greater than the threshold of the resolvable picture uniformity by the human eye, when determining differences between the adjusted average value of the other area and other areas adjacent to it to be greater than the threshold of the resolvable picture uniformity by the human eye, and repeating this step until the differences between the respective two adjacent areas after adjusting all are not greater than the threshold of the resolvable picture uniformity by the human eye.

Further, in the image processing apparatus in accordance with another embodiment of the present invention, the adjusting unit 404 is configured to:

determine one area having a largest average value among all the areas;

use the area having the largest average value as a reference area to adjust the average values of the other areas than the reference area, so that the differences between the respective two adjacent areas are not larger than the threshold of the resolvable picture uniformity by the human eye.

Further, in a further embodiment of the present invention, as shown in FIG. 4, the image processing apparatus further includes:

a third determining unit 405, configured to calculate an average value of brightness of the image before adjusting in accordance with the average value of each area before adjusting, prior to adjusting all the differences between the average values of the respective two adjacent areas to be not greater than the threshold of the resolvable picture uniformity by the human eye;

a fourth determining unit 406, configured to calculate an average value of brightness of the image after adjusting in accordance with the average value of each area after adjusting, after adjusting all the differences between the average values of the respective two adjacent areas to be not greater than the threshold of the resolvable picture uniformity by the human eye;

a backlight module adjusting unit 407, configured to reduce the luminous brightness of the backlight module of the display panel, when the average value of the brightness of the image after adjusting is determined to be greater than that of the image before adjusting, so that the average value of the brightness of the image after adjusting is less than that of the image before adjusting.

Alternatively, in a yet further embodiment of the present invention, as shown in FIG. 4, the image processing apparatus further includes:

a fourth determining unit 406, configured to calculate an average value of brightness of the image after adjusting in accordance with the average value of each area after adjusting, after adjusting all the differences between the average values of the respective two adjacent areas to be not greater than the threshold of the resolvable picture uniformity by the human eye;

a backlight module adjusting unit 407, configured to reduce the luminous brightness of the backlight module of the display panel by the average value of the brightness of the image after adjusting.

It can be seen from the above description of the embodiments of the present invention, the skilled person can clearly understand that the embodiments of the present invention can be implemented by hardware or a combination of a software and a necessarily general hardware platform. It can be known from this understanding that the technical solution of the present embodiment can be embodied in the form of a software product, which can be stored within a non-volatile storage medium (for example, CD-ROM, U disk, mobile disk or the like). The medium includes a plurality of instructions to instruct one computer device (for example, a personal computer, a server or a network device and so on) to execute the methods of the respective embodiments of the present invention.

The skilled person can understand the accompanying drawings are only the schematic views of a preferred embodiment, and blocks or flows within the drawings are not necessary for implementing the present invention.

The skilled person can understand the blocks within the apparatus in accordance with the present invention can be provided within the apparatus of the embodiment according to the description of the embodiments, or can be provided within one or more apparatuses of the present embodiment through the corresponding changes. The modules of the above embodiments can be combined into a single module, or can be divided into several sub-modules.

The numbers of the embodiments of the present invention only are for illustration, not indicating preference of the embodiments.

Within the image processing method and apparatus in accordance with the embodiments of the present invention, after the acquired single picture image is divided into a plurality of areas in accordance with the preset regulations, the average value of the brightness and/or chromaticity is determined; the difference between the average values of the respective two adjacent areas is determined, and the uniformity of the single picture image displayed on the display panel is determined in accordance with the respective differences and the threshold of the resolvable picture uniformity by the human eye; when determining the single picture image displayed on the display panel to be not uniform, the difference of the average values of the respective two adjacent areas is adjusted to be not greater than the threshold of the resolvable picture uniformity by the human eye, so that the non-uniform areas of the image displayed on the display panel can reach the irresolvable level, thereby improving the grade of the screen of the display panel.

Although several exemplary embodiments have been shown and described, the present invention is not limited to those and it would be appreciated by those skilled in the art that various changes or modifications may be made in these embodiments without departing from the principles and spirit of the disclosure. These changes or modifications also fall within the scope of the present invention. The scope of the present invention is defined by the claims and their equivalents.

What is claimed is:

1. An image processing method, comprising the steps of:

acquiring a single picture image displayed on a display panel;

determining an average value of each area relating to a display parameter, after the acquired single picture image is divided into a plurality of areas according to a preset regulation;

determining differences between average values of respective two adjacent areas, and determining a uniformity of the single picture image displayed on the display panel in accordance with a relationship between each difference and a threshold of a resolvable picture uniformity by a human eye to be 0.5;

adjusting the difference between the average values of the respective two adjacent areas to be not greater than the threshold of the resolvable picture uniformity by the human eye, when determining the single picture image displayed on the display panel to be not uniform, wherein the step of adjusting the difference between the average values of the respective two adjacent areas to be not greater than the threshold of the resolvable picture uniformity by the human eye comprises:

determining two adjacent areas corresponding to any difference among all the differences that are greater than the threshold of the resolvable picture uniformity by the human eye;

for the determined two adjacent areas, using one area having a lower average value as a reference area to adjust the average value of the other area so that the difference of them is not greater than the threshold of the resolvable picture uniformity by the human eye;

adjusting average values of other areas adjacent to the other area so that the difference therebetween is not greater than the threshold of the resolvable picture uniformity by the human eye, when determining differences between the adjusted average values of the other area and other areas adjacent to it to be greater than the threshold of the resolvable picture uniformity by the human eye, and repeating this step until the differences between the respective two adjacent areas after adjusting all are not greater than the threshold of the resolvable picture uniformity by the human eye.

2. The method as claimed in claim 1, wherein, the step of determining the uniformity of the single picture image displayed on the display panel comprises:

when determining any difference to be greater than the threshold of the resolvable picture uniformity by the human eye, determining the single picture image displayed on the display panel to be not uniform;

when determining all the differences to be not greater than the threshold of the resolvable picture uniformity by the human eye, determining the single picture image displayed on the display panel to be uniform.

3. The method as claimed in claim 1, further comprising:

calculating an average value of brightness of the image before adjusting in accordance with an average value of each area before adjusting, before the differences between the averages values of the respective two adjacent areas are adjusted to be not greater than the threshold of the resolvable picture uniformity by the human eye;

calculating an average value of brightness of the image after adjusting in accordance with an average value of each area after adjusting, after the differences between the averages values of the respective two adjacent areas are adjusted to be not greater than the threshold of the resolvable picture uniformity by the human eye;

reducing a luminous brightness of a backlight module of the display panel so that the average value of the brightness of the image after adjusting is less than the average value of the brightness of the image before adjusting, when determining the average value of the brightness of the image after adjusting to be greater than the average value of the brightness of the image before adjusting.

4. The method as claimed in claim 1, further comprising:

calculating an average value of brightness of the image after adjusting in accordance with an average value of each area after adjusting, after the differences between the averages values of the respective two adjacent areas are adjusted to be not greater than the threshold of the resolvable picture uniformity by the human eye;

reducing a luminous brightness of a backlight module of the display panel by the average value of the brightness of the image after adjusting.

5. The method as claimed in claim 1, wherein the average value relating to the display parameter is an average value of brightness, an average value of chromaticity, or a combination of them.

6. An image processing apparatus for performing the method as claimed in claim 1, comprising:

an image acquiring unit, configured to acquire a single picture image displayed on a display panel;

a first determining unit, configured to determine an average value of each area relating to a display parameter, after the acquired single picture image is divided into a plurality of areas according to a preset regulation;

a second determining unit, configured to determine differences between average values of respective two adjacent areas, and determine a uniformity of the single picture image displayed on the display panel in accordance with a relationship between each difference and a threshold of a resolvable picture uniformity by a human eye to be 0.5;

an adjusting unit, configured to adjust the difference between the average values of the respective two adjacent areas to be not greater than the threshold of the resolvable picture uniformity by the human eye, when determining the single picture image displayed on the display panel to be not uniform, wherein the adjusting unit is configured to:

determine two adjacent areas corresponding to any difference among all the differences that are greater than the threshold of the resolvable picture uniformity by the human eye;

for the determined two adjacent areas, use one area having a lower average value as a reference area to adjust the average value of the other area so that the difference of them is not greater than the threshold of the resolvable picture uniformity by the human eye;

adjust average values of other areas adjacent to the other area so that the difference therebetween is not greater than the threshold of the resolvable picture uniformity by the human eye, when determining differences between the adjusted average value of the other area and other areas adjacent to it to be greater than the threshold of the resolvable picture uniformity by the human eye, and repeating this step until the differences between the respective two adjacent areas after adjusting all are not greater than the threshold of the resolvable picture uniformity by the human eye.

7. The apparatus as claimed in claim 6, wherein the second determining unit is configured to:

determine the single picture image displayed on the display panel to be not uniform, when determining any difference to be greater than the threshold of the resolvable picture uniformity by the human eye;

determine the single picture image displayed on the display panel to be uniform, when determining all the differences to be not greater than the threshold of the resolvable picture uniformity by the human eye.

8. The apparatus as claimed in claim 6, further comprising:

a third determining unit, configured to calculate an average value of brightness of the image before adjusting in accordance with an average value of each area before adjusting, before the differences between the averages values of the respective two adjacent areas are adjusted to be not greater than the threshold of the resolvable picture uniformity by the human eye;

a fourth determining unit, configured to calculate an average value of brightness of the image after adjusting in accordance with an average value of each area after adjusting, after the differences between the averages values of the respective two adjacent areas are adjusted to be not greater than the threshold of the resolvable picture uniformity by the human eye;

a backlight module adjusting unit, configured to reduce a luminous brightness of a backlight module of the display panel so that the average value of the brightness of the image after adjusting is less than the average value of the brightness of the image before adjusting.

9. The apparatus as claimed in claim 6, further comprising:

a fourth determining unit, configured to calculate an average value of brightness of the image after adjusting in accordance with an average value of each area after adjusting, after the differences between the averages values of the respective two adjacent areas are adjusted to be not greater than the threshold of the resolvable picture uniformity by the human eye;

a backlight module adjusting unit, configured to reduce a luminous brightness of a backlight module of the display panel by the average value of the brightness of the image after adjusting.

10. The apparatus as claimed in claim 6, wherein the average value relating to the display parameter is an average value of brightness, an average value of chromaticity, or a combination of them.

11. An image processing method, comprising the steps of:

acquiring a single picture image displayed on a display panel;

determining an average value of each area relating to a display parameter, after the acquired single picture image is divided into a plurality of areas according to a preset regulation;

determining differences between average values of respective two adjacent areas, and determining a uniformity of the single picture image displayed on the display panel in accordance with a relationship between each difference and a threshold of a resolvable picture uniformity by a human eye to be 0.5;

adjusting the difference between the average values of the respective two adjacent areas to be not greater than the threshold of the resolvable picture uniformity by the human eye, when determining the single picture image displayed on the display panel to be not uniform, wherein the step of adjusting the difference between the average values of the respective two adjacent areas to be not greater than the threshold of the resolvable picture uniformity by the human eye comprises:

determining one area having a largest average value among all the areas;

using the area having the largest average value as a reference area to adjust the average values of the other areas than the reference area, so that the differences between the respective two adjacent areas are not greater than the threshold of the resolvable picture uniformity by the human eye.

12. The method as claimed in claim 11, wherein, the step of determining the uniformity of the single picture image displayed on the display panel comprises:

when determining any difference to be greater than the threshold of the resolvable picture uniformity by the human eye, determining the single picture image displayed on the display panel to be not uniform;

when determining all the differences to be not greater than the threshold of the resolvable picture uniformity by the human eye, determining the single picture image displayed on the display panel to be uniform.

13. The method as claimed in claim 11, further comprising:

calculating an average value of brightness of the image before adjusting in accordance with an average value of each area before adjusting, before the differences between the averages values of the respective two adjacent areas are adjusted to be not greater than the threshold of the resolvable picture uniformity by the human eye;

calculating an average value of brightness of the image after adjusting in accordance with an average value of each area after adjusting, after the differences between the averages values of the respective two adjacent areas are adjusted to be not greater than the threshold of the resolvable picture uniformity by the human eye;

reducing a luminous brightness of a backlight module of the display panel so that the average value of the brightness of the image after adjusting is less than the average value of the brightness of the image before adjusting, when determining the average value of the brightness of the image after adjusting to be greater than the average value of the brightness of the image before adjusting.

14. The method as claimed in claim 11, further comprising:

calculating an average value of brightness of the image after adjusting in accordance with an average value of each area after adjusting, after the differences between the averages values of the respective two adjacent areas are adjusted to be not greater than the threshold of the resolvable picture uniformity by the human eye;

reducing a luminous brightness of a backlight module of the display panel by the average value of the brightness of the image after adjusting.

15. The method as claimed in claim 11, wherein the average value relating to the display parameter is an average value of brightness, an average value of chromaticity, or a combination of them.

16. An image processing apparatus for performing the method as claimed in claim 11, comprising:

an image acquiring unit, configured to acquire a single picture image displayed on a display panel;

a first determining unit, configured to determine an average value of each area relating to a display parameter, after the acquired single picture image is divided into a plurality of areas according to a preset regulation;

a second determining unit, configured to determine differences between average values of respective two adjacent areas, and determine a uniformity of the single picture image displayed on the display panel in accordance with a relationship between each difference and a threshold of a resolvable picture uniformity by a human eye to be 0.5;

an adjusting unit, configured to adjust the difference between the average values of the respective two adjacent areas to be not greater than the threshold of the resolvable picture uniformity by the human eye, when determining the single picture image displayed on the display panel to be not uniform, wherein the adjusting unit is configured to:

determine one area having a largest average value among all the areas;

use the area having the largest average value as a reference area to adjust the average values of the other areas than the reference area, so that the differences between the respective two adjacent areas are not greater than the threshold of the resolvable picture uniformity by the human eye.

17. The apparatus as claimed in claim 16, wherein the second determining unit is configured to:

determine the single picture image displayed on the display panel to be not uniform, when determining any difference to be greater than the threshold of the resolvable picture uniformity by the human eye;

determine the single picture image displayed on the display panel to be uniform, when determining all the differences to be not greater than the threshold of the resolvable picture uniformity by the human eye.

18. The apparatus as claimed in claim 16, further comprising:

a third determining unit, configured to calculate an average value of brightness of the image before adjusting in accordance with an average value of each area before adjusting, before the differences between the averages values of the respective two adjacent areas are adjusted to be not greater than the threshold of the resolvable picture uniformity by the human eye;

a fourth determining unit, configured to calculate an average value of brightness of the image after adjusting in accordance with an average value of each area after adjusting, after the differences between the averages values of the respective two adjacent areas are adjusted to be not greater than the threshold of the resolvable picture uniformity by the human eye;

a backlight module adjusting unit, configured to reduce a luminous brightness of a backlight module of the display panel so that the average value of the brightness of the image after adjusting is less than the average value of the brightness of the image before adjusting.

19. The apparatus as claimed in claim 16, further comprising:

a fourth determining unit, configured to calculate an average value of brightness of the image after adjusting in accordance with an average value of each area after adjusting, after the differences between the averages values of the respective two adjacent areas are adjusted to be not greater than the threshold of the resolvable picture uniformity by the human eye;

a backlight module adjusting unit, configured to reduce a luminous brightness of a backlight module of the display panel by the average value of the brightness of the image after adjusting.

20. The apparatus as claimed in claim 16, wherein the average value relating to the display parameter is an average value of brightness, an average value of chromaticity, or a combination of them.

* * * * *